US006976350B2

(12) United States Patent
Greening et al.

(10) Patent No.: US 6,976,350 B2
(45) Date of Patent: Dec. 20, 2005

(54) BAG PRESENTER FOR A PACKAGING MACHINE

(75) Inventors: Douglas Christian Greening, Calgary (CA); Authur Stephen Withington, Calgary (CA); Ralph Enzler, Calgary (CA)

(73) Assignee: Boss Packaging Inc., Calgary (CA)

( * ) Notice: Subject to any disclaimer, the term of this patent is extended or adjusted under 35 U.S.C. 154(b) by 0 days.

(21) Appl. No.: 10/605,691

(22) Filed: Oct. 17, 2003

(65) Prior Publication Data

US 2004/0168412 A1 Sep. 2, 2004

Related U.S. Application Data

(60) Provisional application No. 60/419,100, filed on Oct. 18, 2002.

(51) Int. Cl.[7] ..... B65B 43/26
(52) U.S. Cl. ..... 53/571; 53/567; 53/573; 53/384.1
(58) Field of Search ..... 53/459, 468, 567, 53/570, 571, 573, 384.1, 385.1, 386.1

(56) References Cited

U.S. PATENT DOCUMENTS

| | | | | |
|---|---|---|---|---|
| 2,332,187 | A * | 10/1943 | Allen | 53/571 |
| 2,943,687 | A * | 7/1960 | Merry et al. | 172/125 |
| 3,830,038 | A * | 8/1974 | Propst | 53/77 |
| 4,033,096 | A | 7/1977 | Burgat et al. | |
| 4,078,358 | A * | 3/1978 | Henderson | 53/459 |
| 4,172,349 | A * | 10/1979 | Lipes | 53/459 |
| 4,253,292 | A * | 3/1981 | Lipes | 53/502 |
| 4,359,214 | A | 11/1982 | Eldridge | |
| 4,698,952 | A | 10/1987 | Oberdorf | |
| 5,127,207 | A | 7/1992 | Cunningham | |
| 5,201,166 | A * | 4/1993 | Johnsen | 53/571 |
| 5,337,541 | A * | 8/1994 | Gmuer | 53/459 |
| 5,442,898 | A * | 8/1995 | Gabree et al. | 53/459 |
| 5,802,817 | A * | 9/1998 | Hood | 53/459 |
| 5,970,688 | A | 10/1999 | Nyiendo et al. | |
| 6,101,787 | A | 8/2000 | Brintazzoli et al. | |
| 6,282,871 | B1 * | 9/2001 | Killinger et al. | 53/459 |
| 6,658,823 | B2 * | 12/2003 | Johnsen et al. | 53/492 |
| 6,662,532 | B1 * | 12/2003 | Droog et al. | 53/459 |

FOREIGN PATENT DOCUMENTS

CA 1081668 10/1978

(Continued)

OTHER PUBLICATIONS

High-Speed Automatic Bagger Uses Pre-Made Wicketed Bags Baggerboss™ Automatic Bagger © 2001.

*Primary Examiner*—Stephen F. Gerrity
*Assistant Examiner*—Hemant M. Desai
(74) *Attorney, Agent, or Firm*—Bennett Jones LLP

(57) ABSTRACT

A bag presenter for moving a bag from a bag supply toward a packaging machine filling station, the bag presenter comprising: a bag supply holding area, a gripper for holding a bag in the filling station and a bag handler for moving the bag from the holding area toward the gripper, the bag handler including a bag feeder and a bag conveyor, the bag feeder being operable to pull a bag from a bottom of the bag supply holding area and to pass the bag to the bag conveyor. The bag handler can include a bag opening mechanism and a means for maintaining the bag in an open configuration, once the bag has been opened. The bag presenter is useful for handling non-wicketed bags and can be used to convert a packaging machine from reliance on wicketed bags to use of non-wicketed bags.

20 Claims, 12 Drawing Sheets

FOREIGN PATENT DOCUMENTS

| | | |
|---|---|---|
| CA | 1328673 | 9/1989 |
| CA | 2009640 | 2/1990 |
| CA | 2128889 | 2/1993 |
| CA | 2129480 | 8/1994 |
| CA | 2213182 | 8/1997 |
| CA | 2366412 | 9/1997 |

* cited by examiner

BAG PRESENTER FOR A PACKAGING MACHINE

REFERENCE TO RELATED APPLICATIONS

This application claims priority from U.S. provisional application No. 60/419,100, filed Oct. 18, 2002.

BACKGROUND OF INVENTION

This invention relates to an apparatus for handling bags and positioning them for handling by a packaging machine for filling the bags. More particularly, the invention can relate to a bag presenting apparatus for moving bags from a bag supply to a filling station of a packaging machine and at the same time opening the bags in preparation for filling.

In packaging processes, bags can be used to contain loose articles, such as loose foodstuffs, etc. The bags include a pair of side panels of, for example, polymeric or metallic materials. The bags for filling in the packaging machine can be generally square or rectangular and sealed along three sides by any of various means including fusing, adhesives, folding, gusseting or by reclosable seals such as elongate interlocking channels. Thus, the bags are left with one open side, through which the loose articles can be introduced to the bag. After filling the open side is closed as by use of one of the above-noted closure means.

The bags are generally either wicketed or non-wicketed. Wicketed bags include a pair of apertures at an edge of the bag, the holes being used to mount the bags on a pair of spaced apart pins in the filling station of the packaging machine. The edge of the bag containing the holes after filling serves no other purpose and is, therefore, often cut off later in the packaging process, thereby creating waste and represents extra material and handling costs.

Non-wicketed bags, which do not include holes for mounting in the machine, can be stacked in some way and pulled off the stack one at a time for filling by the machine.

Packaging machines are quite elaborate structures. Some packaging machines, such as the BaggerBoss™ packaging machine, produced by the applicant of the present application, are produced to handle only wicketed bags. If a company wishes to move to the use of non-wicketed bags, a whole new packaging machine usually must be purchased and installed.

SUMMARY OF INVENTION

An apparatus for presenting bags to the filling station of a packaging machine has been invented.

In one aspect of the present invention, there is provided a bag presenter apparatus for use to present a bag for filling by a packaging machine, the bag including a first side panel and an opposite side panel and the packaging machine having a filling station including a filling chute and a filled bag conveyor, the bag presenter apparatus comprising: a bag gripper for holding the bag to be filled by the packaging machine relative to the filling chute of the packaging machine such that materials from the chute can be introduced to the bag and the bag gripper configurable to hold the first side panel of the bag and in a position conducive to engagement of the bag by the filled bag conveyor of the packaging machine.

In another broad aspect of the present invention, there is provided a bag presenter for moving a bag from a bag supply to a packaging machine filling station, the bag presenter comprising: a bag supply holding area, a gripper for holding a bag in the filling station and a bag handler for moving the bag from the holding area toward the gripper, the bag handler including a bag opening mechanism and a means for maintaining a bag in an opened configuration once opened.

BRIEF DESCRIPTION OF DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION

Figure 1:
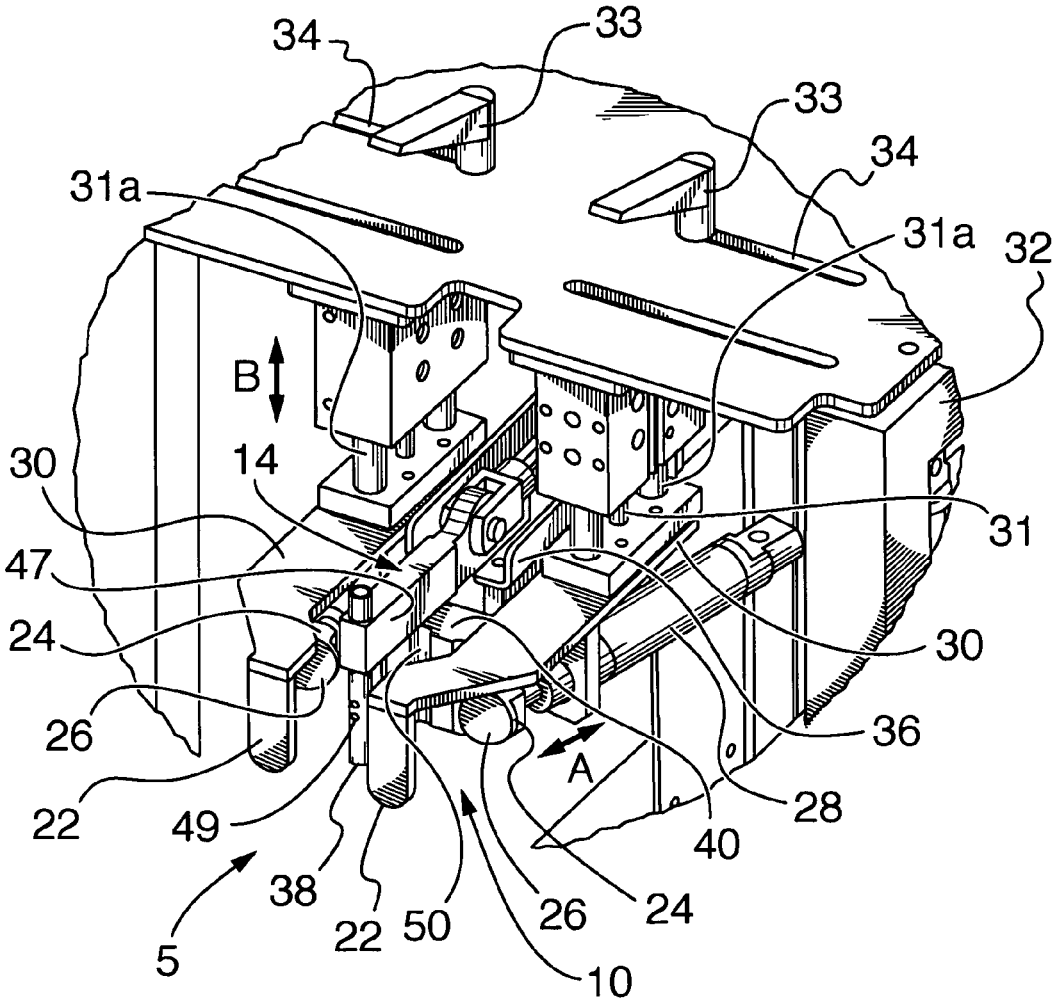
FIG. 1 is a perspective view of a bag presenter according to the present invention.

In the drawings, like items or substantially like items are indicated by like reference numerals. In the present application, the term "non-wicketed bag" refers to a bag without mounting pin apertures.

An apparatus for presenting bags can be arranged to operate in various ways with a packaging machine filling station. In one embodiment, for example, the apparatus can be used to convert a packaging machine intended for handling wicketed bags only to a machine capable also of handling non-wicketed bags.

In one embodiment, a bag presenter apparatus is provided for use to present a bag for filling by a packaging machine, the bag including a first side panel and an opposite side panel and the packaging machine having a filling station including a filling chute and a filled bag conveyor, the bag presenter apparatus including: a bag gripper for holding the bag to be filled by the packaging machine relative to the filling chute of the packaging machine such that materials from the chute can be introduced to the bag and the bag gripper configurable to hold the first side panel of the bag and in a position conducive to engagement of the bag by the filled bag conveyor of the packaging machine.

The bag presenter apparatus can be a stand-alone unit and be mountable relative to the filling chute of a wicketed bag-packaging machine. The bag presenter apparatus can be positionable in the wicket pin area of the bag-packaging machine when the wicket pins have been moved out of the way.

The bag gripper can be configurable to hold the bag such that the filled back conveyor can engage the bag for conveyance in a manner substantially similar to a bag held by wicket pins.

The bag gripper can include any suitable arrangement for securely holding a bag for filling. As such the gripping means can, for example, include one or more of pincers, clamps, fingers, suction cups that will hold the bag. In one embodiment, the gripping means is selected to hold the bag so that the bag is substantially restricted from pivoting about a single axis substantially orthogonal to the plane of the side panel of the bag. The gripping means can be selected to grip one side panel of the bag and can be configured to hold the bag in an open arrangement with one side panel held away from the second side panel. It may be desirable to select the gripping means such that they do not puncture or rip the bag during gripping or for release. In one embodiment, the gripping means is a pair of spaced apart grippers for holding a side panel of the bag in a manner similar to that resulting from the use of wicket support pins. In another embodiment, the gripping means is a clamp selected to grip the bag over a surface area selected to substantially prevent the bag from pivoting about a single axis orthogonal to the plane of the side panel of the bag.

The bag presenting apparatus can be a moveable structure that is removably positionable relative to a filling station of a packaging machine. In such an embodiment, for example, the bag presenting apparatus can include a support frame mounted on wheels, the wheels being releasably lockable once the apparatus is in a selected position. Alternately, the bag presenting apparatus can be intended for permanent installation in or relative to the filling station of a packaging machine.

In one embodiment, the apparatus can be sized and configured with consideration as to the height and orientation of a filling station on a packaging machine such that a bag gripping means on the apparatus can be positioned to hold a bag below the filling chute of the filling station and in a position suitable for being picked up by the conveying mechanisms of the packaging machine, for example, once it is filled.

The bag presenter can include a bag handler for moving the bags from a bag supply to be positioned relative to the filling station. The bag handler can be one or more of moveable arms, plungers, conveyers, rollers, chutes, pincers, grippers, blowers, vacuum devices, etc. In an embodiment, the bag handler operates in coordination with, but separately from, the gripping means for holding the bag relative to the filling station, such that a subsequent bag can be handled by the apparatus while a first bag is being held for filling. In another embodiment, the bag handler includes a plurality of mechanisms that operate in coordination with, but separately from, each other so that a plurality of bags can be handled at the same time by the apparatus.

In one embodiment, the bag presenting apparatus includes bag quality and/or orientation check devices for checking the position of, and/or reorienting, the bag as it is moved through the apparatus. The check device can, for example, be a stop mechanism, which stops the bag during its movement through the apparatus and squares it relative to the bag direction of travel. Other check devices can include vacuum and/or light sensors. Such devices can, for example, sense when a bag has jammed in the conveyor and is not moving properly through the apparatus. Alternately or in addition, they can sense when a bag is not properly opening. The apparatus can include a holder for bags rejected by the check devices.

The bag presenting apparatus in an embodiment includes a bag opener for opening the bag during the process of passing the bag to the filling station. The bag opener can include for example one or more of: pincers, grippers, suction cups, vacuum suction devices, air jet devices, plungers, rams, etc.

In another embodiment, the bag presenter of the present invention includes a bag feeder for pulling the bags to be filled, one at a time from a supply of bags and feeding them to a bag handler. The bag feeder can include a bag picker including suction device such as for example, suction cups, vacuum tubes, etc. or grippers such as for example pincers, rollers, etc. for engaging a bag and moving it into the apparatus for further handling. In one embodiment, the bag presenter includes a holding area for supporting a supply stack of bags, each bag in flat configuration. In one embodiment, the bag pick up means engages and pulls the bags from the bottom of the stack. The holding area can include a bottom floor onto which the stack rests. The holding area floor includes an opening through which the bag is pulled, the floor being configured such that the bag is supported by the floor on at least two sides of the opening. In one embodiment, two parallel edges of the bag will rest on the floor on either side of the opening when the bags are stacked in the holding area. In another embodiment, the leading end of the bag, as determined by the pulling direction of the bag feeder, and the trailing end of the bag are supported by the floor while a side panel of the bag rests over the opening. The leading end and the trailing end can be the edge of the bag or a portion of the bag adjacent the edge. The opening can include a slot extending from side to side in the holding area, to ease the passage therethrough of stiff bag portions such as, bag portions having resealable lock channels mounted thereon.

The bag feeder can include a mechanism for pulling the bags from the holding area and passing a leading end of the bag to a conveyor system, which engages the bag leading end to move the bag to a filling station.

The apparatus can be arranged such that bag handling is substantially along one long axis so that the apparatus can be installed or positioned in side by side configuration to present bags to multiple filling stations, which are also configured in side by side configuration.

Thus a bag presenter can include a bag gripping means for holding a bag to be filled by the packaging machine relative to the filling chute of the packaging machine such that materials from the chute can be filled to the bag and the gripping means configurable to hold the bag in a position conducive to engagement by the filled bag conveyor of the packaging machine.

In one embodiment, the bag presenter is a stand alone unit and is mountable relative to the filling chute of a wicketed bag packaging machine. In another embodiment, the bag gripper means includes a pair of spaced apart grippers selected to grip a side panel of the bag to be filled at two spaced apart points.

In another embodiment, a bag presenter includes a bag supply holding area, a gripper for holding a bag relative to the filling station of a packaging machine and a conveyor for moving the bag from the holding area toward the gripper, the conveyor including a belt and a bag orientation means acting relative to the belt to ensure appropriate bag orientation in the conveyor.

The bag orientation means can include a stop mechanism, selected to stop advancement of a bag moved by the belt and to orient the bag relative to the belt direction of travel. The stop mechanism can be movable into and out of an operable position to stop advancement of a bag. In one embodiment, the stop mechanism is a pair of stop walls and can be driven to extend through, and be retracted from, a drive surface plane defined by the surface of the belt.

In this embodiment, the conveyor can further include a bag opening mechanism including engaging devices selected to engage the side panels of a bag and pull them apart. The bag opening mechanism can include a sensor for detecting a non-opening bag.

The bag presenter can further include a bag handler for carrying a bag from the conveyor to the gripper. In such an embodiment, the conveyor can be selected to move a subsequent bag into position for moving to the gripper when the bag handler is carrying a first bag from the conveyor to the gripper. The bag handler can be, for example, an arm moveable between the conveyor and the gripper, and the conveyor is operable to move a subsequent bag into position for engagement by the arm when the arm is carrying a first bag to the gripper.

The bag presenter can further include a bag feeder for moving a bag from the bag holding area to the conveyor.

Another bag presenter includes a bag supply holding area, a gripper for holding a bag relative to the filling station of a packaging machine and a bag handler for moving the bag from the holding area toward the gripper, the bag handler including a bag opening mechanism and a means for maintaining a bag in an opened configuration once opened.

The bag handler can further comprise a bag opening mechanism including engaging devices selected to engage the side panels of a bag and pull them apart. The bag opening mechanism can include a sensor for detecting a non-opening bag.

In such an embodiment, the means for maintaining a bag in an opened configuration can comprise an air jet device for directing a jet of air into the opened bag. The air jet device can be mounted on a bag engaging device.

The means for maintaining the bag in an opened configuration can alternately or in addition be a gripping device selected to grip a side panel of the bag and to deform the bag side panel such that the side edges of the bag side panel are drawn together creating a slack situation in the opposite side panel of the bag tending to cause the opposite side panel of the bag to be forced outwardly away from the gripped side panel. In one such embodiment, the means for maintaining a bag in an opened configuration comprises a gripping device including a first jaw and a second jaw, the first jaw and the second jaw being driveable into engagement with each other to grip a side panel of a bag therebetween, the first jaw having a protrusion extending therefrom and the second jaw having a cavity formed thereon, the protrusion being selected to sit within the cavity, when the jaws are brought into engagement with each other. The first jaw can be an elongate pin including an end and a side surface and the second jaw is a base including a groove formed therein sized to accept the side surface of the pin therein.

Figure 2:
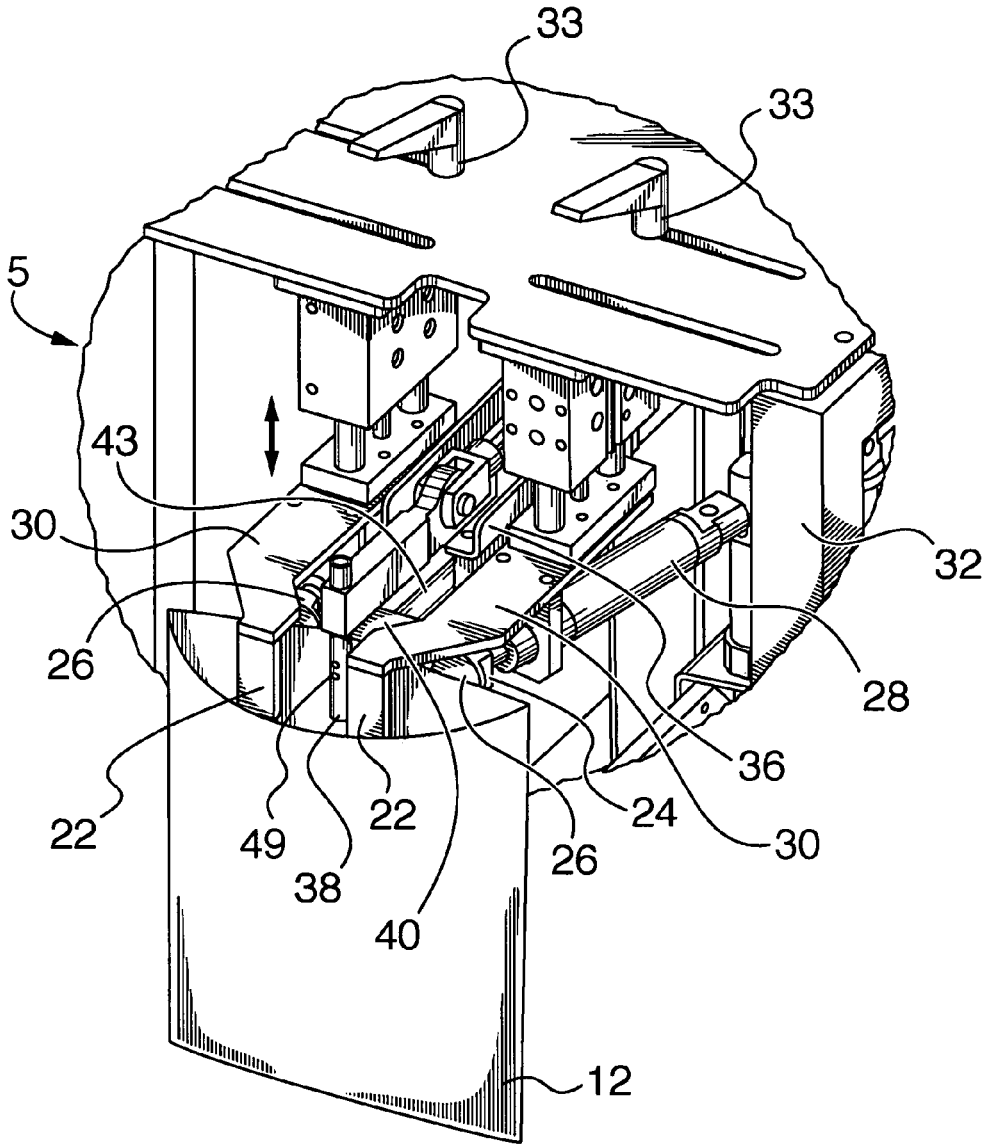
FIG. 2 is a view of the bag presenter of FIG. 1 with a bag positioned in preparation for gripping thereof.

A bag presenter 5 according to one embodiment of the present invention is shown in FIGS. 1 and 2. The bag presenter 5 includes a bag gripping means 10 for gripping a bag 12 in preparation for filling thereof. The bag presenter also includes a bag handler 14 for moving the bag from a bag supply (not shown) to bag gripping means 10. The bag presenter can be used for handling non-wicketed bags.

Figure 3:
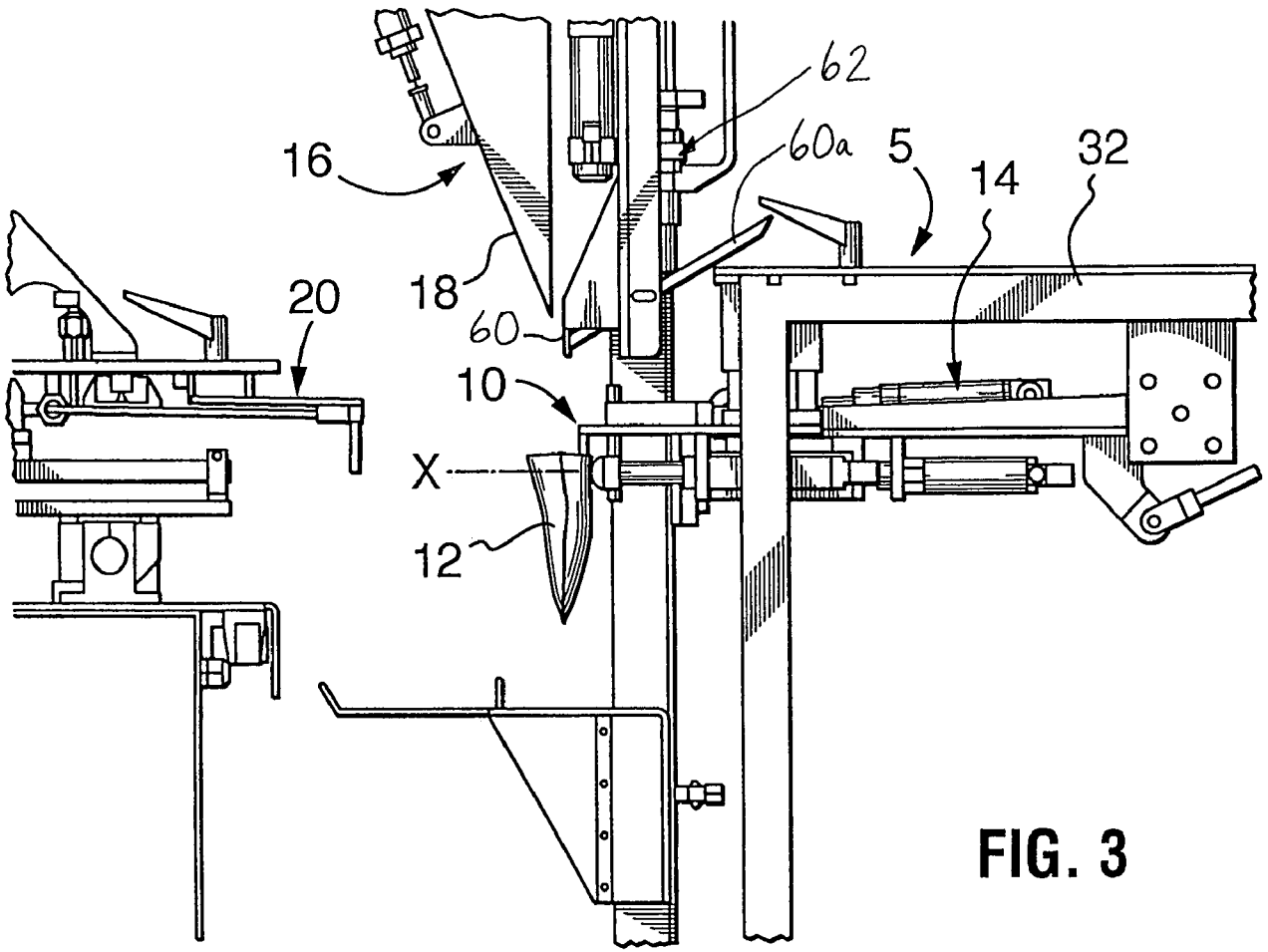
FIG. 3 is a side elevation of the bag presenter of FIG. 1, holding a bag relative to the filling chute of a packaging machine.

As shown in FIG. 3, bag presenter 5 is positioned and configured to grip bag 12 in a position aligned for filling by a packaging machine 16 and, in particular, for filling by a filling chute 18 in the filling station of the packaging machine. The bag presenter is further configured and positioned to hold bag 12 in such a way that it is positioned for engagement by the filled bag handling mechanisms 20 of the packaging machine.

The bag gripping means is selected to grip the bag in such a way that there is substantially no rotation about an axis orthogonal to the plane of the side panel gripped. The bag gripping means 10 in the illustrated embodiment includes a pair of stop fingers 22 and a pair of driven fingers 24 which can be brought together with one driven finger of the pair driven against one of the stop fingers and the other of the driven fingers of the pair driven against the other one of the stop fingers. A bag can therefore be gripped between the fingers, wherein fingers 22 are inserted into the bag between its side panels and a side panel of the bag is gripped between the stop fingers 22 and the driven fingers 24. The tip 26 of each driven finger can be formed of deformable material, such as an elastomer, to enhance the gripping action.

Each of the driven fingers move, as shown by arrow A, toward and away from their stop finger by action of a cylinder 28, such as of air or hydraulics, or by other means such as screw drives or solenoids as desired. Fingers 22 are each mounted on a frame 30 moveable, as in arrow B, to drive fingers 22 into the bag for gripping and out of the bag for release thereof. This movement is often generally vertically, as the bag during gripping is generally vertically oriented and opening upwardly. The frame can be moved by drive cylinders 31 guided by guide rods 31*a*. Fingers 24 are connected to frame 30 and are vertically moved with fingers 22. Movement of fingers 22 and 24 are relative to a frame 32 in which the bag gripping means is mounted.

The bag presenter can be selected to grip the bag in such a way that it is opened with its side panels held apart. This is accomplished in the illustrated embodiment, first by the location of stop fingers 22 within the bag during holding and also selection of the spacing of the gripping points. In particular, in the illustrated embodiment, the fingers 22 are spaced apart a distance less than the actual points on the bag that are gripped by the fingers. This provides that the side panel, which is gripped, has formed therein a deformation that draws the side edges of the bag closer together, which causes slack in the free side panel causing it to bend away from the gripped side panel.

The bag presenter can be provided with spacing adjustment slides in slots 34 for selecting the spacing between fingers 22. Threaded caps 33 on the slides permit the slides to be locked in a selected position along the slots. The spacing of fingers 22 should be selected so that the bag is held firmly and substantially against rotation about axis x. In general, the fingers are often spaced about one half the width of the bag between its side edges.

In operation, the bag presenter is positioned so that fingers 22 are positioned to hold a bag in a position for filling under a filling chute in a packaging machine filling station. A bag is then positioned between fingers 22 and fingers 24 and fingers 24 are driven by their attached cylinders to drive against fingers 22 with the bag gripped therebetween. The bag is then filled, as the fingers continue to grip it. The filled bag is then picked up by bag handling mechanisms 20 and at the same time, fingers 24 move away from fingers 22 and fingers 22 are moved up and out of the bag. Thereafter, fingers 22 are then lowered into position ready for gripping a next bag. Fingers 22 can cycle through their movement in a very short time, so as not to limit packaging rates. The bag presenting apparatus can be controlled by a control system, such as a programmable logic controller. In one embodiment, there is a communication system operating between the packaging machine and the bag presenter to provide synchronization therebetween. In another embodiment, a sensor on the packaging machine determines that a bag is ready in the gripping means ready for filling.

Bag handler 14 of the illustrated embodiment, includes a moveable arm 36 having mounted thereon for movement therewith a gripper pin 38 and a pin abutment block 40. The pin acts as a stop against which abutment block 40 engages. In particular, abutment block 40 is driven towards and away from pin 38 by a cylinder 42. In particular, cylinder 42 is fixed on arm 36 and abutment block 40 is mounted on the rod 43 of the cylinder (FIG. 10). Guide 44 is provided to support rod 43 as it reciprocates block 40. Block 40 can be advanced to engage a bag side panel and drive it against pin 38 to thereby engage that bag on arm 36 such that the bag can be moved by and with the arm.

Figure 10A:
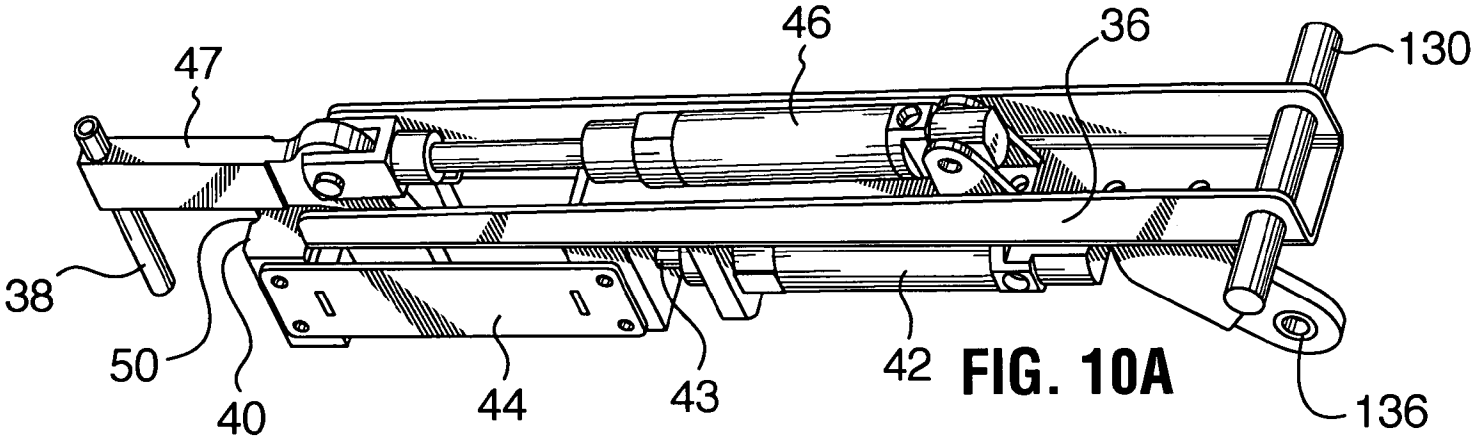
FIG. 10*a* is an enlarged perspective view of a bag-handling arm useful in a bag presenter.
Figure 10B:
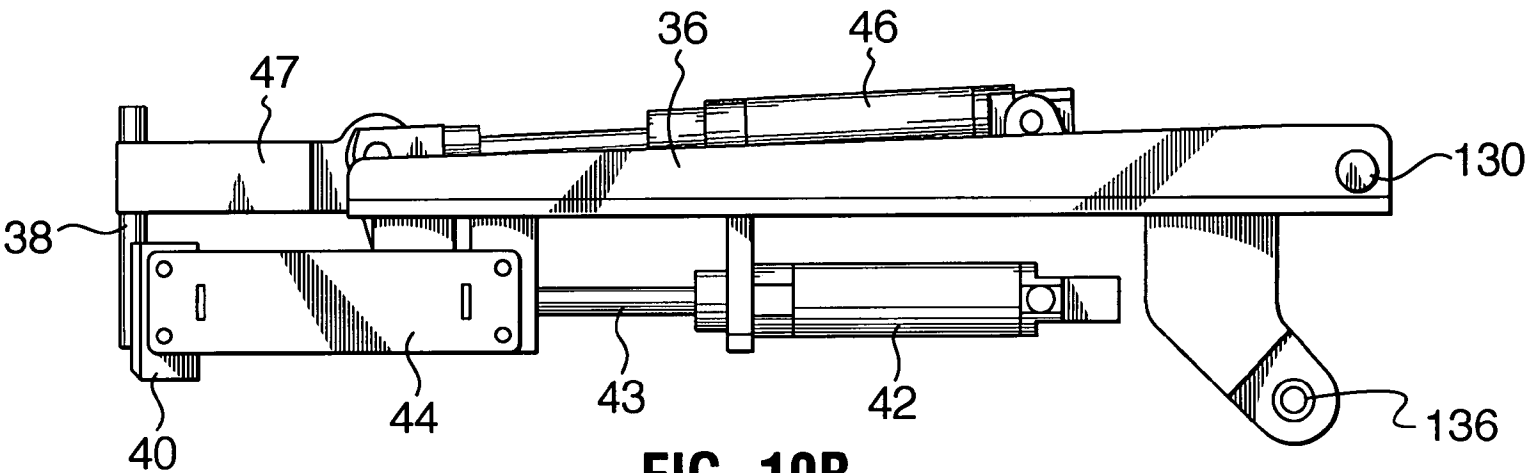
FIG. 10*b* is a side elevation of the bag-handling arm of FIG. 10*a* with the pin engaged against the abutment block and resting in the groove.
Figure 10C:
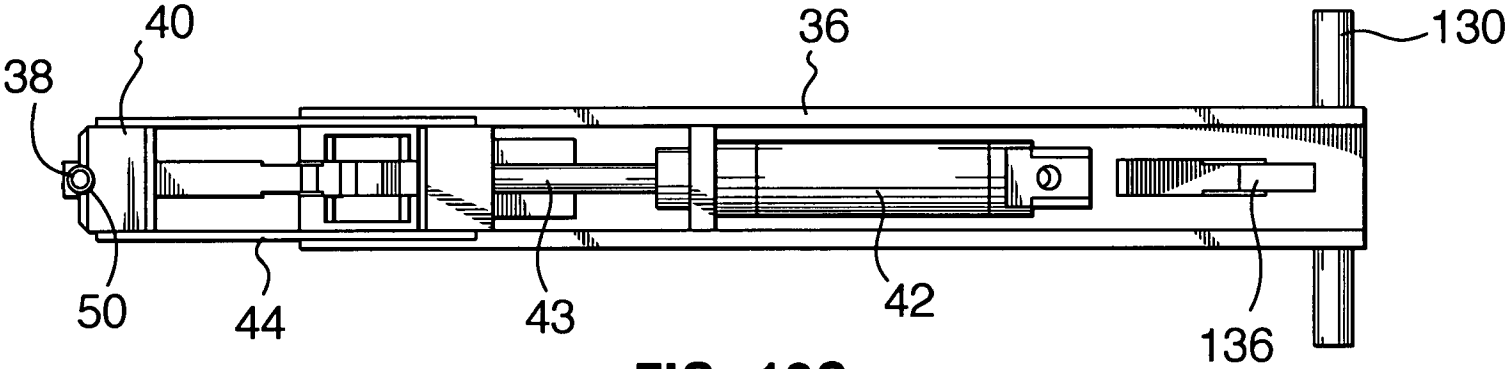
FIG. 10*c* is a bottom plan view of the bag-handling arm of FIG. 10*b*.
Figure 10D:
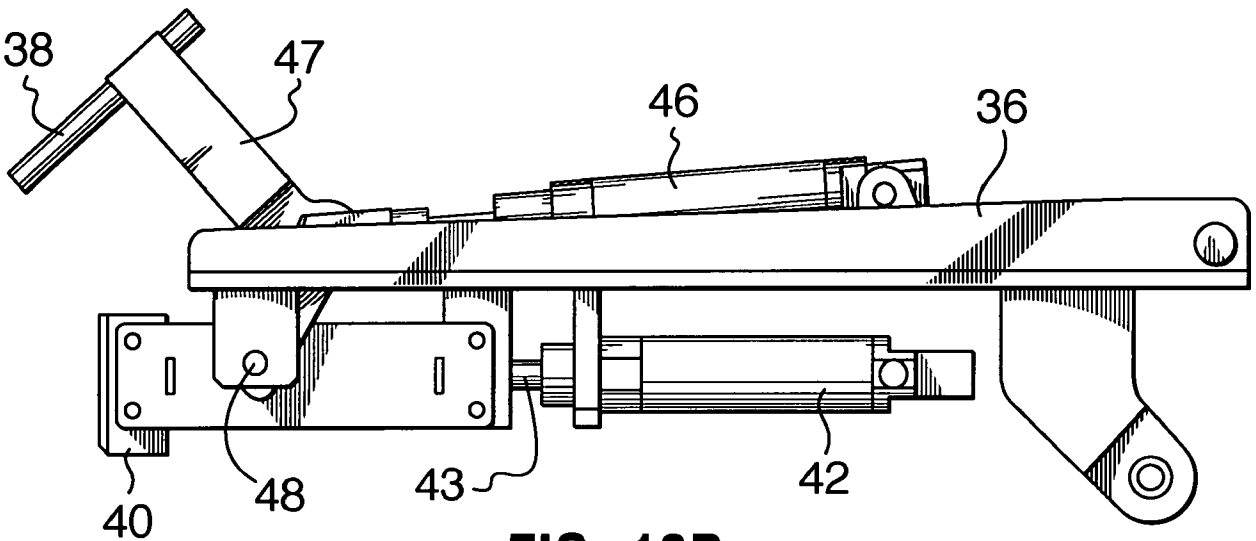
FIG. 10*d* is a side elevation of a bag-handling arm similar to that of FIG. 10*a* with the pin in a raised position.

Pin 38 and block 40 are positioned on arm 36 with consideration as to the orientation of fingers 22, 24 so that any bag side panel gripped between pin 38 and block 40 will be brought up between fingers 22 and fingers 24 so that it can be gripped by fingers 22, 24. After the bag is gripped between fingers 22, 24, block 40 can be pulled back from pin 38 and the pin can be pivoted up out of the bag by, for example, action of cylinder 46 driving pin mount 47 about a fulcrum 48 by pulling back on the mount (FIG. 10*d*). Once pin 38 and block 40 are clear of the bag, arm 36 can be moved to engage a subsequent bag and bring it into position for engagement by fingers 22, 24.

Bag handler 14 includes a bag opening means including air jetting ports 49 on pin 38. In addition, block 40 includes a groove 50 into which pin 38 sits when block is engaged thereagainst. This arrangement is again selected to form a deformation in the bag panel gripped therebetween to draw the bag sides together and to urge the bag into an open configuration during handling. In the illustrated embodiment, this deformation is passed to and maintained by, the gripping means 10, since the fingers 22, 24 grip the bag directly.

Figure 4:
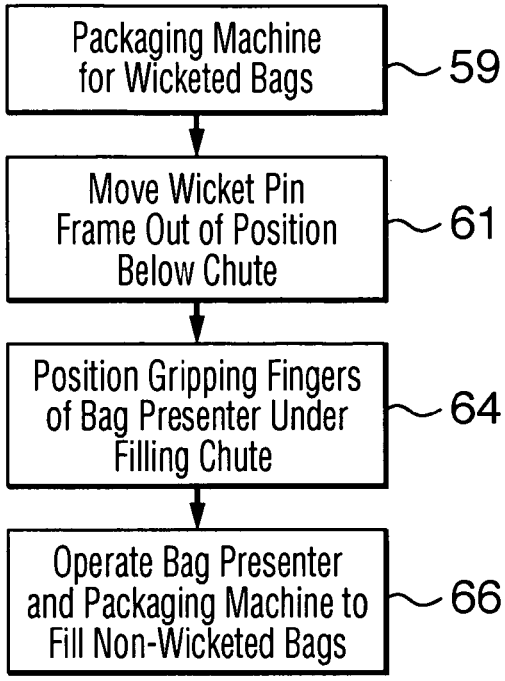
FIG. 4 is a flow chart showing a method for use of a bag presenter according to the present invention.

With reference to also FIG. 4, the bag presenter of the present invention, such as that shown in FIG. 1 can be used to convert temporarily or permanently the bag handling capabilities of a packaging machine 59 from use of wicketed bags to use of non-wicketed bags. To do this, the wicket mounting pin frame 60 with wicket pins 60*a* mounted thereon is raised 61 out of the way, as by use of positioning screws 62. The bag presenter is then positioned 64 so that fingers 22 are oriented relative to chute 18 so that any bag gripped by fingers 22 will be open to receive materials passing from the chute. The bag presenter can then be operated 66 with the operation of the packaging machine to fill non-wicketed bags. The bag presenter can be permanently installed in this position or positioned only temporarily. If it is desired to return to packaging of wicketed bags, the bag presenter can be removed and mounting pin frame 60 can be repositioned for use with chute 18.

With the bag presenter of FIGS. 1 and 2, the bag, although not wicketed, is held in a manner similar to wicketed bags, wherein a side panel of the bag is held at two spaced apart places. As such, the bag presenter of the present invention is particularly suited for use in the permanent or temporary conversion of a packaging machine for wicketed bags to handle non-wicketed bags, representing a more cost effective packaging option.

Figure 5:
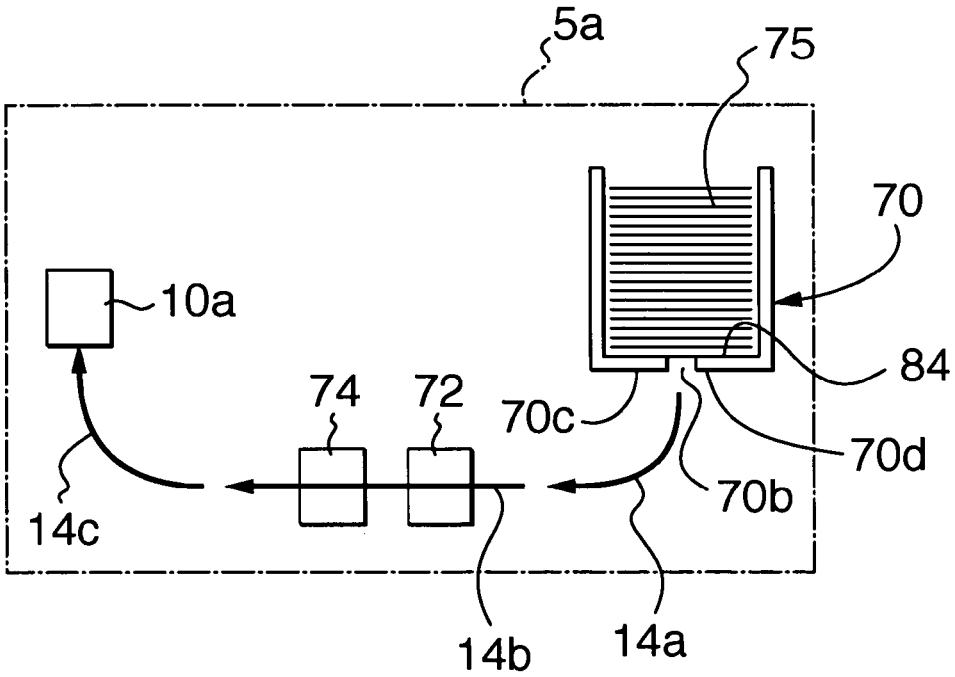
FIG. 5 is a schematic drawing of another bag presenter according to the present invention.

A bag presenter 5*a* according to another embodiment is shown in FIG. 5. The bag presenter 5*a* includes a bag supply holding area 70, a bag gripping means 10*a* for gripping a bag in preparation for filling thereof and bag handlers 14*a*, 14*b* and 14*c* that move the bag from the bag supply to the bag gripping means 10*a*. The bag presenter also includes a bag orientation check device 72 for ensuring the bag is properly oriented for handling by the apparatus and a bag opening means 74. The bag presenter can be used for handling non-wicketed bags.

Bag presenter 5*a* accommodates a supply of bags 75 in bag supply holding area 70 and conveys the bags one at a time from the stack to bag gripping means 10*a* where each bag in turn is positioned ready for filling by a packaging machine. Apparatus 5*a* advantageously includes a plurality of bag handlers 14*a*, 14*b*, 14*c* so that more than one bag can be handled by the apparatus simultaneously.

Bag holding area 70 supports the bag supply stack with the bags each lying flat and one on top of the other. The floor 84 of the holding area includes an opening 70*b* through which the bags are drawn by bag handler 14*a*. The opening is positioned on the floor of the holding area such that sections of the floor including front ledge 70*c* and rear ledge 70*d* are disposed on either side of opening, rather than it being disposed at an extreme edge of the floor. This provides that the stack is supported at both its leading and trailing ends while bags are being drawn down through the opening, tending to ensure that only one bag at a time is pulled from the stack.

Subsequent bag handlers 14*b*, 14*c* accept a bag from bag handler 14*a* and advance it toward bag gripping means 10*a*. Bag orientation check device 72 is positioned to ensure that the bag is properly positioned and oriented for handling.

Bag opening means 74 open the bag during handling so that it is in condition ready for accepting items. The bag opening means can include, for example, a holding means and a pair of grippers, which together hold the bag and grip its side panels to pull them apart and open the bag.

Bag gripping means 10*a* finally holds the bag in a position ready for filling. Bag gripping means 10*a* includes a holding mechanism, which grips a side panel of the bag at two points such that the bag is held in position similar to that of a wicketed bag. The holding mechanism can be positioned relative to a packaging machine so that the bag will be positioned ready for filling and further handling by the packaging machine.

Referring to FIGS. 6 to 10, there is shown another bag presenting apparatus according to the present invention. The bag presenter 5*b* includes a bag supply holding area 70*a*, a bag gripping means 10 for gripping a bag in preparation for filling thereof and bag handlers that move the bag from the holding area to the bag gripping means including a bag feeder 76 for pulling the bags one at a time from the holding area and a conveyor 78 and a moveable arm 36 for in turn accepting and advancing the pulled bag. The bag presenter also includes, in conveyor 78, a bag orientation check device 72 for ensuring the bag is properly oriented for handling by the apparatus and bag opening means including a device 80 for pulling the side panels of the bag apart and an erection ram 82.

Bag supply holding area 70*a* is constructed to hold a supply of bags in flattened configuration. The bags are generally loaded into the holding area in a stack with their open ends in a selected direction for proper handling by the bag presenter. In this embodiment, any bags are loaded such that when pulled, their open end becomes the leading edge. Bag supply holding area 70*a* includes a floor support 84 on which the bags rest. Front wall 85 and side walls 86 extend up about the floor. Side walls 86 are positionable using threaded posts 88 in slots 89 or other means so that the distance between the walls can be adjusted to urge the walls up against the sides of the stack. Thereby, bag supply holding area 70*a* is adjustable to accept bags of various sizes.

Floor support 84 can be tilted from a horizontal position so that the stack of bags tends to be forced against front wall 85 of the area. This together with adjustment of walls 86 tends to maintain the stack in a selected and substantially ordered orientation in the holding area.

Floor support 84 includes an opening defined by floor edges 90, 91. The opening is positioned on the floor such that floor support surfaces are disposed on either side of the opening to support the bags at two end. To remove the bags one at a time from the stack, the bottom most bag is engaged from its side panel exposed through the slot and pulled down through the slot.

Bag holding area 70*a*, in the illustrated embodiment, is selected to be suitable for handling bags having resealable lock channels mounted thereon. In particular, the opening is extended between side edges 93 to form a slot across floor 84.

Bag feeder 76 pulls the bags from bag supply holding area 70*a*. In particular, the bag feeder engages the exposed side panel of the bottom most bag through the slot and pulls the bag down through the slot. The bag feeder includes a suction means, such as suction cups 94 or vacuum handlers, to engage the side panel on its planar surface and a drive mechanism 96 to pull the suction means and an engaged bag down through the slot.

Bag feeder 76 also moves the engaged bag into engagement with conveyor 78. In particular, bag feeder 76 includes a drive 96, which acts to both pull the bag down and thereafter to move the bag forward into conveyor 78. The drive mechanism can maintain the orientation of the bag during this bag transport so that the bags, when loaded to the bag holding area, can be in the same orientation as when they are presented to the conveyor. In the illustrated embodiment the drive mechanism includes a pair of cylinders, the first of which moves suction cups 94 up and down relative to the opening in floor support 84 and the second of which moves the suction cups toward and away from conveyor 78. A sensor (for example in place of sensor 105 described hereinbelow) can be provided in association with this mechanism to determine if a bag has been engaged by the suction cups, to thereby control activities of the bag presenting apparatus including the bag feeder and conveyor 78.

Conveyor 78 includes a pair of pinched belts each with a conveyor belt 102 and a pinch roller 104, acting against belt 102. Pinch rollers 104 are driven into and out of engagement against belts 201 in response to the arrival of a bag from drive mechanism 96, as determined by a sensor 105 that can be positioned in various locations but in the illustrated embodiment is shown above a belt. In particular, bag feeder 76 can move a bag to rest on belts 102 when rollers 104 are raised away from the belts. Once sensor 105, senses that a bag is located on the conveyor belts, rollers 104 are lowered and belts 102 are driven forward. The pinched belts are spaced apart to engage the two parallel edges of a bag being passed thereto by bag feeder 76. Belts 102 are driven, in the direction indicated by arrow C, by wheels 105, which are attached to a drive shaft 106 of motor 107.

Additional belts, such as belt 102*a*, can be used as desired to support wider bags. Edge guides 113 are spaced above belts 102 leaving a gap therebetween through which a bag can pass. Guides 113 act after pinch rollers 104 to maintain the bag down against the belts and in a flat configuration. Conveyor 78 can include other means, as desired, such as date stamp 114.

The conveyor can be expanded to accommodate various widths of bags. Thus, in the illustrated embodiment, belts 102, guides 113 and rollers 104 are mounted between moveable side frames 115 and an expansion mechanism 108, such as a screw drive, driven by handle 116 is mounted therebetween to permit the side frames to be moved relative to each other. Telescoping portions 110, for example on support roller shaft 112, are provided to allow for the distance adjustment.

At the output end of conveyor 78, a stop device is positioned to stop and check the orientation of the bag being passed through. The stop device includes a pair of spaced apart stop walls 122 (only one can be seen), positioned between conveyor belts 102, extending through the plane of bag travel, as defined by drive surfaces 124 of the belts and square to the direction, arrow C, of travel of the belts. As such, stop walls 122 are positioned to define a plane to which the bag leading edge should be stopped and oriented. In particular, stop walls 122 prevent further advancement of the bag through the conveyer and, in cooperation with the drive of belts 102, orient the bag leading edge square to the conveyor direction of travel. Stop walls 122 are spaced apart to permit access to the conveyer and, thereby any bag stopped against walls 122, as by arm 36. Stop walls 122 are mounted on a retractor (not shown) so that they can be retracted out of the way, for example, when a bag is pulled out by arm 36.

Belts 102, and 102*a* if present, are driven intermittently to advance a bag, but are halted when a sensor 125 senses a bag passing adjacent the output end. The sensor communicates with motor 107 to stop the belts at a time selected to allow a bag moving therethrough to butt against stop walls 122. Clamps 126 can be provided to hold the bag against movement in the conveyor. In particular, once the belts are stopped, clamps 126 are driven down to pinch the bag into engagement with belts 102 and hold the bag for opening by bag opener 80. In another embodiment, clamps can be omitted as the bag opener does not require additional clamping.

Bag opener 80 includes engaging devices 127, such as suction cups or vacuum devices, which are selected to engage each of the side panels of the bag being handled. The engaging devices are mounted to move with an upper cylinder 128 and a lower cylinder (cannot be seen), which can pull the engaging devices apart to, thereby, pull bag side panels engaged by engaging devices 127 apart. For additional opening capabilities, such as where larger bags are to be handled or staged opening is desired, an additional cylinder 129 can be installed to act with cylinder 128. Cylinders 128, 129 are mounted on frame 130. A sensor (cannot be seen) can be operated in cooperation with engaging devices 127 to determine when a bag is not being opened properly, for example where no suction is sensed at a suction cup of the engaging devices. This may occur, for example, where the resealable lock channels are locked on the bag so that the bag cannot be opened with a normal opening force. This sensor can be in communication with a control system that drives a non-opening bag into a holding bin 131 for manual inspection and possible recycling to holding area 70*a*.

If desired, an erection ram 82 can be installed to act on the bag in the conveyor 78. The ram 82 can act on the bag once it has been stopped by stop walls 122 and is held open by mechanism 80. Ram 82 can be positioned to extend between the side panels of the bag once it is opened on the conveyor. Ram 82 is useful where the bag to be handled includes a gusset.

Once the bag is advanced by conveyor 78 and opened by mechanism 80, it is ready for passing to gripping means 10 for filling. In the illustrated embodiment, the apparatus includes a moveable arm 36, which moves the bag to be handled from conveyor 78 to the bag gripping means. Arm 36 is positioned to pivot between the conveyor and gripping means 10 to bring the bag from a horizontal position to a substantially vertical position in preparation for filling. The arm pivots about a fulcrum defined by a pin 130 in a stationary mount 132, as driven by a cylinder 134 attached at clevis 136. In one embodiment, cylinder 134 can be replaced by a motor (not shown). A motor can be adjusted easily to control the arm's range of motion to, for example, accommodate changes in bag and/or apparatus configurations.

Arm 36 includes a bag gripping mechanism such as, for example, that described above with respect to FIGS. 1, 2 and 10 including a pin 38 and block 40.

Bag gripping means 10 can be as described in FIGS. 1 and 2 including fingers 22 and 24.

Note that the apparatus can be constructed to pass the bags generally along one substantially horizontal direction, indicated by arrow D, from holding area 70*a* to bag gripping means 10. This permits the apparatus to be relatively narrow and only slightly wider than the width of a bag to be handled. As such the apparatus can easily mounted in side-by-side configuration and be scaleable to operate with a packaging machine having multiple fill chutes. In addition, because the handlers pass the bags through a range of vertical positions while operating along direction D, the apparatus has a relatively compact length.

Various drive systems can be used for the various conveyors and handlers. In one embodiment, a stepper motor is used.

The apparatus can be controlled in any desired way. However, it will be appreciated that automatic control, such as by use of a programmable logic controller, will facilitate operation.

Figure 6:
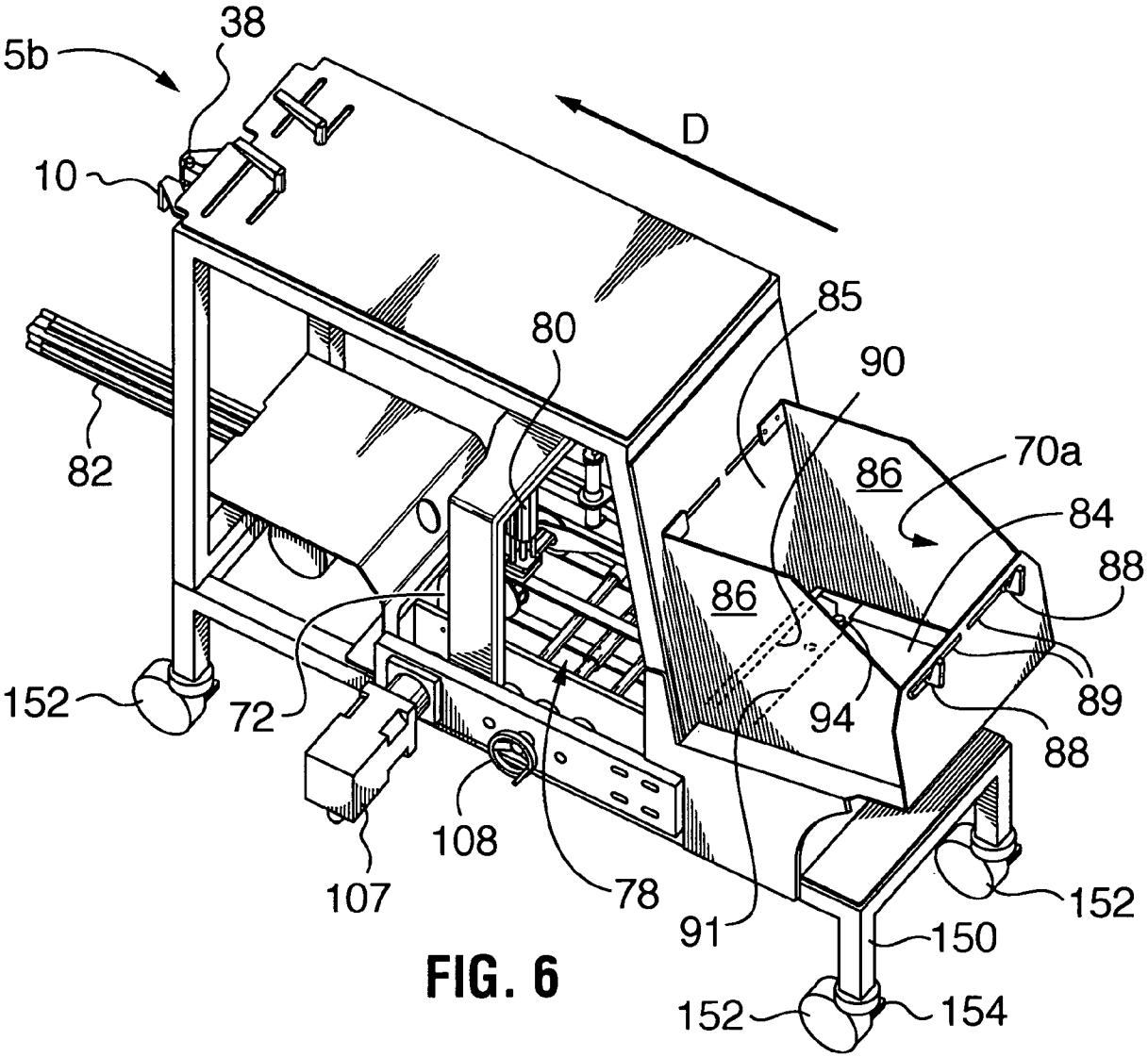
FIG. 6 is a perspective view of a bag presenter according to the present invention.
Figure 7A:
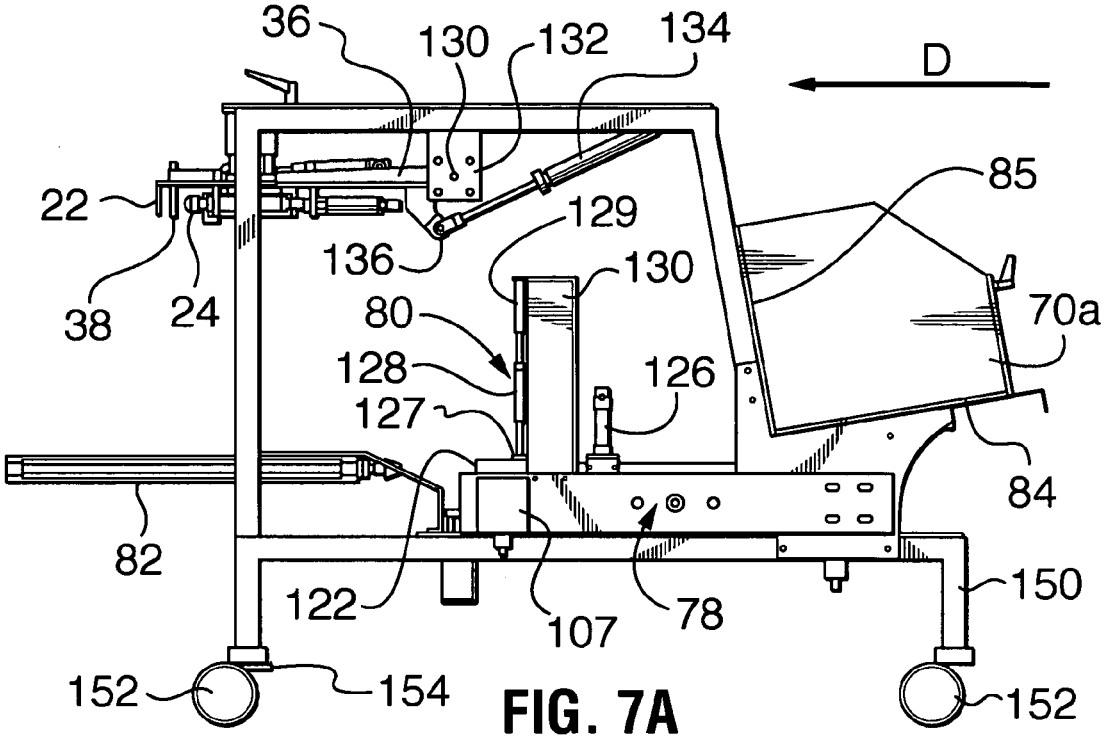
FIG. 7A is a side elevation of the bag presenter of FIG. 6.
Figure 7B:
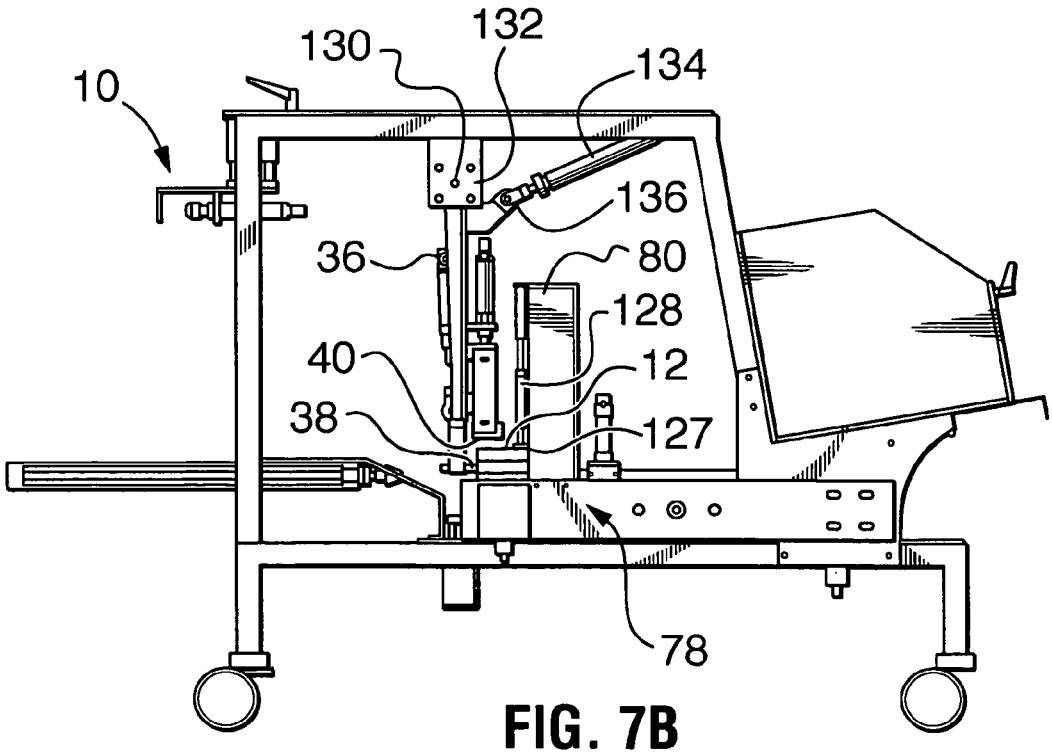
FIG. 7B is a side elevation corresponding to FIG. 7A with the bag-handling arm lowered to engage a bag in the conveyor area.
Figure 7C:
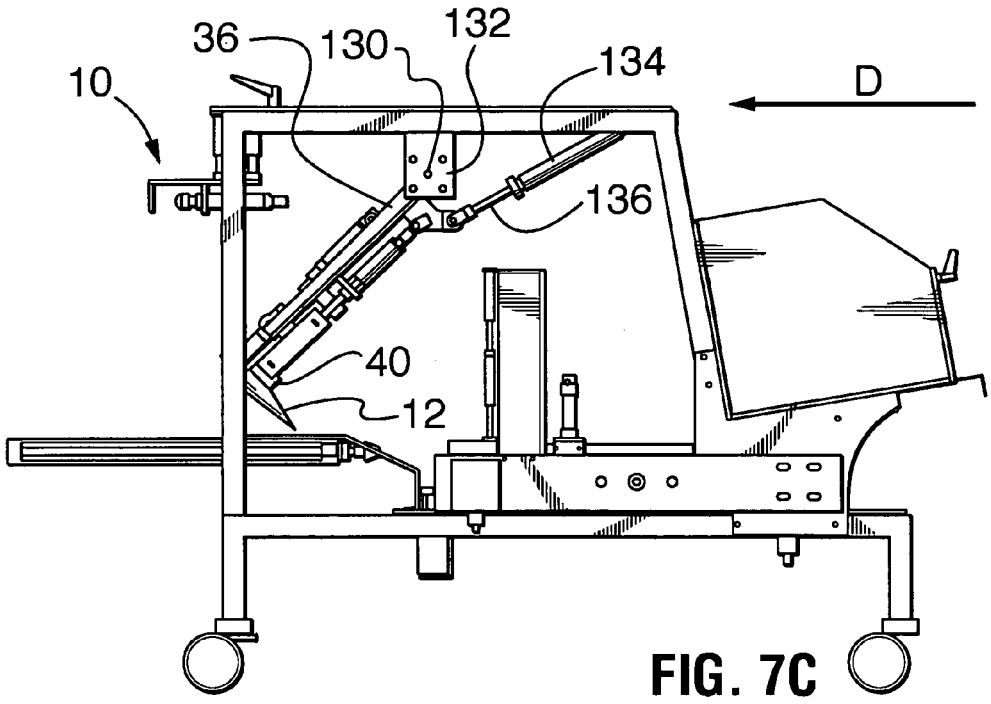
FIG. 7C is a side elevation corresponding to FIG. 7A with the bag-handling arm bringing a bag engaged therein to the bag gripping means.
Figure 8:
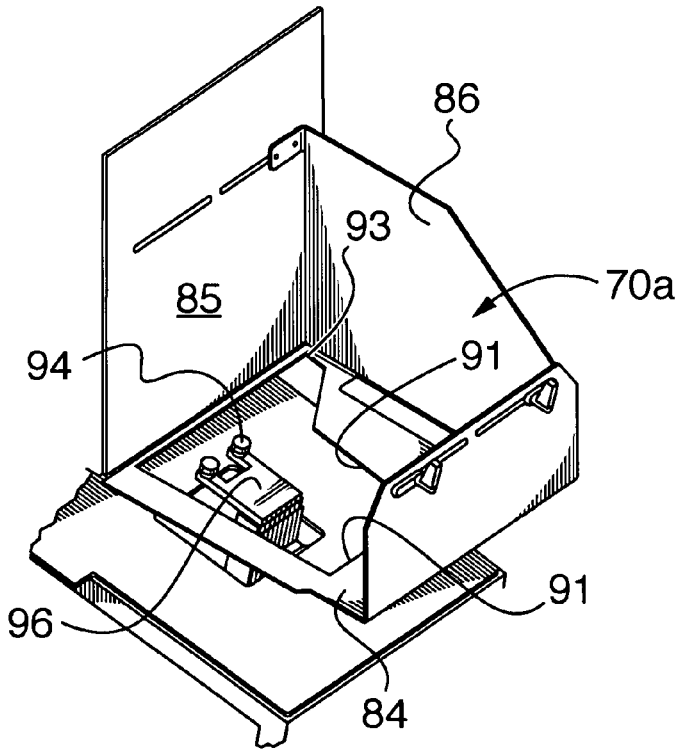
FIG. 8 is an enlarged view, partially cut away of a holding area and bag feeder useful in the bag presenter of FIG. 6.
Figure 9:
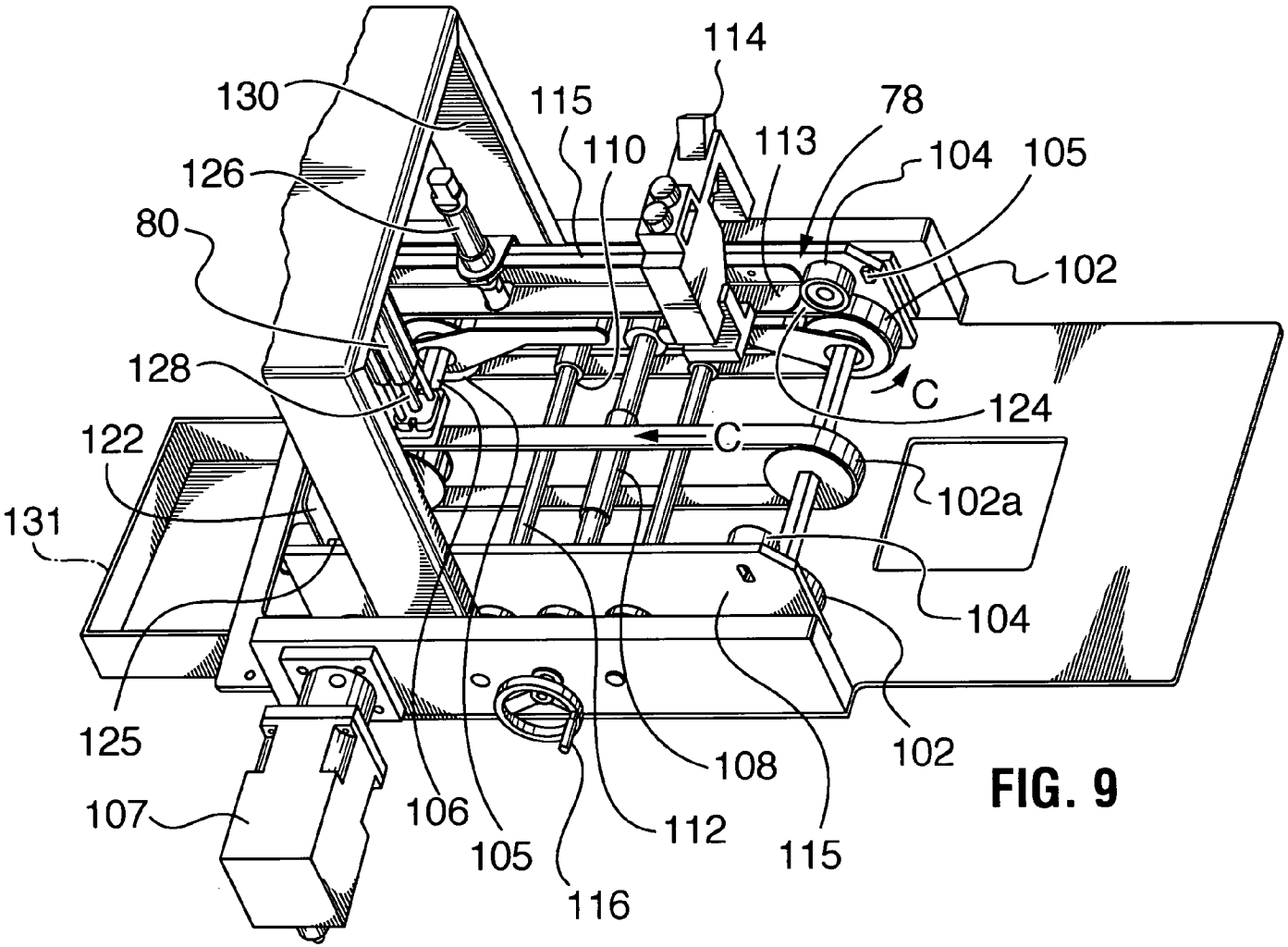
FIG. 9 is an enlarged perspective view of a bag-handling conveyor useful in a bag presenter.

The illustrated bag presenter of FIGS. 6 and 7 can provide a packaging machine with non-wicketed bag handling capability. Thus, the bag presenter can be mounted on a mobile cart 150 riding on wheels 152. Wheels 152 include locks 154 so that the apparatus can be securely positioned for use.

Figure 11:
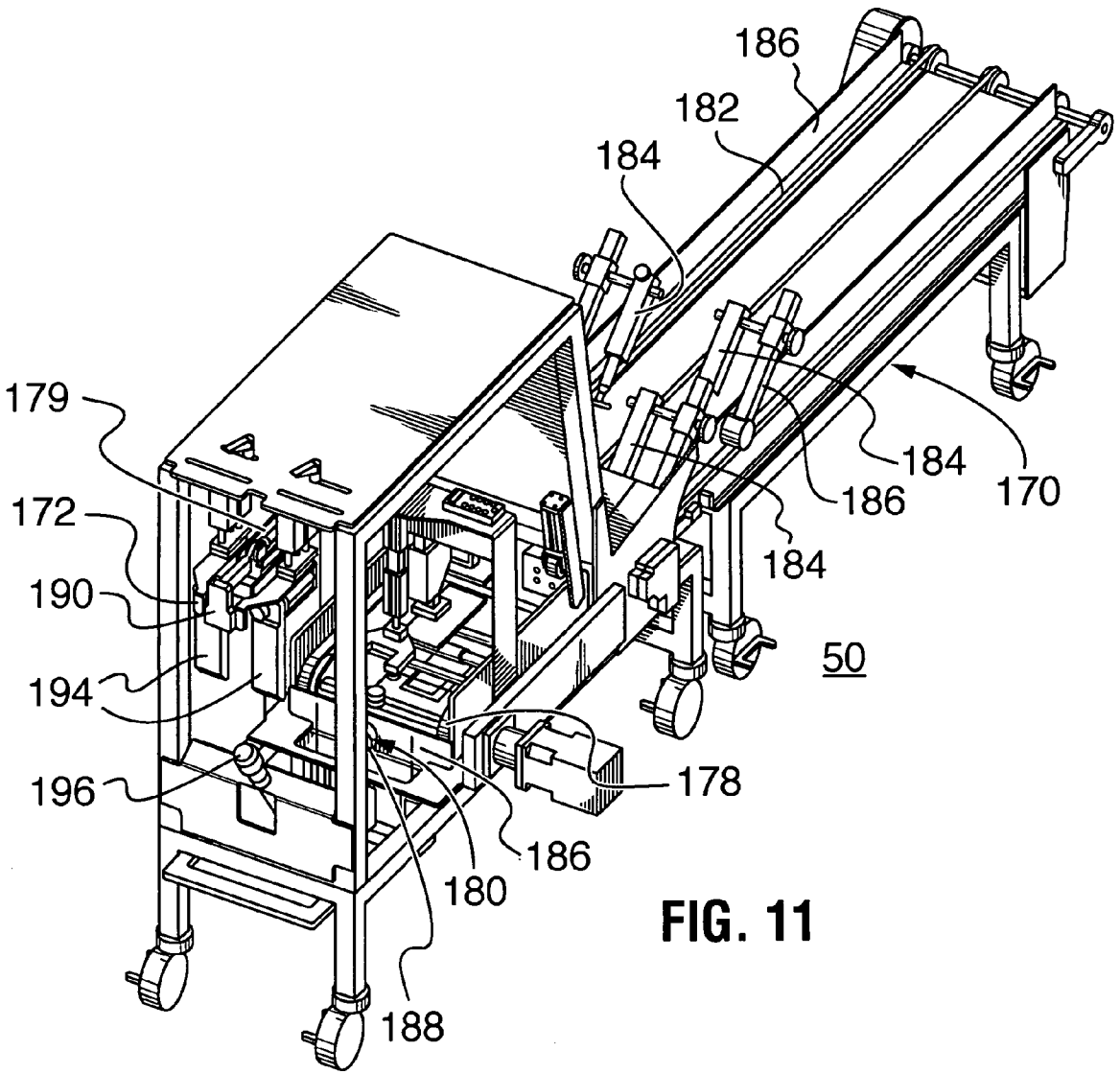
FIG. 11 is a perspective view of another bag presenter.
Figure 12:
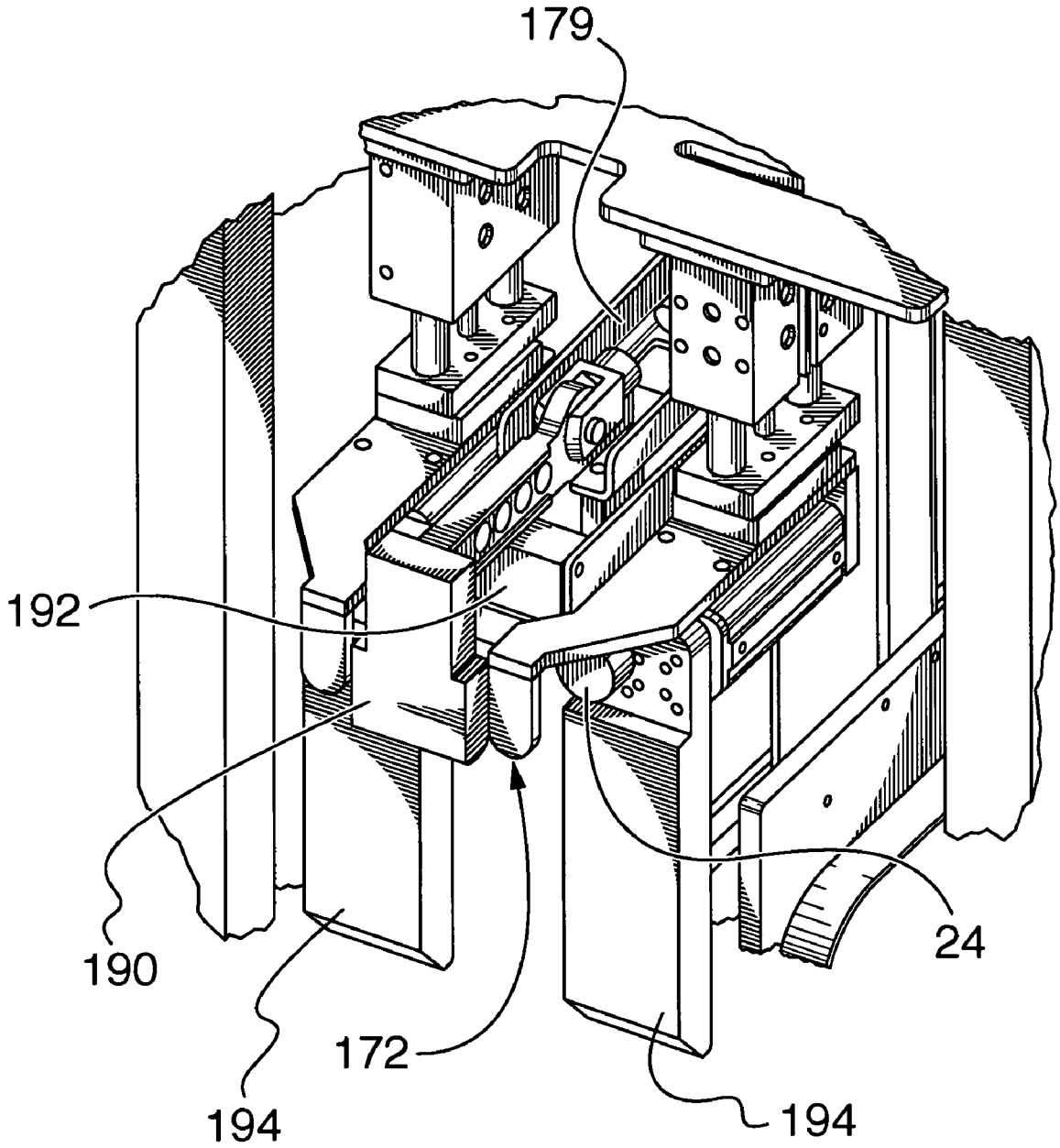
FIG. 12 is a perspective view of a bag gripping device.

Referring to FIGS. 11 and 12, there is shown another bag presenter 5*c*. Bag presenter 5*c* includes a bag supply arrangement 170, a bag gripper 172 for gripping the bag in preparation for introducing materials thereto and bag handlers for moving the bag from the bag supply arrangement to the bag gripper. The bag handlers include a bag feeder (cannot be seen), a conveyor 178 and a moveable arm 179. The bag presenter also includes a bag orientation and opening device 180.

Bag supply arrangement 170 includes a conveyer that fans a supply of bags to be engaged by a bag feeder. The conveyor includes a belt arrangement 182 that moves a line of bags forwardly toward the bag feeder. Fanning fingers 184 disposed above the belt and side walls 186 about the belt urge the bags into a flat, orderly overlapping or spaced apart, aligned series. The bag feeder engages a bottom surface of a bag being advanced on the belt and draws it forward into conveyor 178.

In conveyor 178, a bag is advanced and then stopped and opened before being grasped by moveable arm 179. Device 180 assists in the stopping, orientation and opening of the bag in conveyor 178. Device 180 includes a stop wall 186 that is moved into and out of the conveyor bag handling plane to stop the bags. Stop wall 186 carries an air jet generator 188 that drives a jet of air into an opened bag to temporarily inflate it, as may be desirable to open a bag gusset.

Moveable arm 179 carries a bag gripping mechanism including an internal block 190 for inserting between the side panels of a bag to be grasped and an external block 192 for pinching a bag panel to internal block 190. Internal block 190 is enlarged to hold the side panels apart once it is inserted therein. Blocks 190, 192 are positioned to engage the bag substantially centrally. However, in another embodiment the bag gripping mechanism can include a pair of spaced apart grippers that grip the bag adjacent its side seams.

Bag gripper 172 includes support members 194, 196 for supporting the filled weight of the bag against tearing out of the engagement or sagging out of position for proper handling. Support members 194 are carried on driven fingers 24 for supporting behind the bag. Support member 196 reciprocates up and down beneath the bag to support its bottom end.

The apparatus can be constructed in various ways with various materials, as would be appreciated by a skilled workman. If desired, the apparatus can be adapted for sanitary handling of food stuffs by use of stainless steel and sealed components suitable for wash down.

It will be apparent that many other changes may be made to the illustrative embodiments, while falling within the scope of the invention and it is intended that all such changes be covered by the claims appended hereto.

What is claimed is:

1. A bag presenter apparatus for use to present a bag for filling by a packaging machine, the bag including a first side panel and an opposite side panel and the packaging machine having a filling station including a filling chute and a filled bag conveyor, the bag presenter apparatus comprising: a bag gripper for holding the bag to be filled by the packaging machine relative to the filling chute of the packaging machine such that materials from the chute can be introduced to the bag, the bag gripper operable to hold the bag to be filled without wicket pins also engaging the bag and the bag gripper configurable to hold the first side panel of the bag and in a position conducive to engagement of the bag by the filled bag conveyor of the packaging machine; a conveyor for moving the bag from a supply area toward the bag gripper; and a bag handler for carrying the bag from the conveyor to the gripper.

2. The bag presenter apparatus of claim 1 being a standalone unit and being mountable relative to the filling chute of a wicketed bag-packaging machine.

3. The bag presenter apparatus of claim 1 being a stand-alone unit positionable below the filling chute of the bag-packaging machine when any wicket pins have been moved out of the way.

4. The bag presenter apparatus of claim 1 wherein the bag gripper includes a pair of spaced apart gripping fingers positioned to hold the bag at two positions such that the filled bag conveyor can engage the bag for conveyance in a manner substantially similar to a wicketed bag holding configuration.

5. The bag presenter apparatus of claim 1 wherein the bag gripper includes a pair of spaced apart gripping pinchers selected to grip a first side panel of the bag to be filled at two spaced apart fixed points.

6. The bag presenter apparatus of claim 1 wherein the bag presenter moves the bag to be filled along a substantially uniform direction from a bag supply area to the bag gripper.

7. The bag presenter apparatus of claim 1 wherein the conveyor including a belt and a bag orientating device acting relative to the belt to ensure appropriate bag orientation in the conveyor.

8. The bag presenter of claim 7 wherein the bag orientating device includes a stop mechanism, selected to stop advancement of the bag to be filled moved by the belt and to orient the bag relative to the belt direction of travel.

9. The bag presenter of claim 8 wherein the stop mechanism is movable into and out of an operable position to stop advancement of the bag to be filled.

10. The bag presenter of claim 9 wherein the stop mechanism can be driven to extend through and to retract from, a drive surface plane defined by the surface of the belt.

11. The bag presenter of claim 7 wherein the conveyor is expandable to adjust for various bag widths.

12. The bag presenter of claim 1, wherein the conveyor comprises a bag opening mechanism including engaging devices selected to engage the side panels of the bag and pull them apart.

13. The bag presenter of claim 12 wherein the bag opening mechanism includes a sensor for detecting a non-opening bag.

14. The bag presenter of claim 1 wherein the conveyor is selected to move a subsequent bag into position for moving to the gripper when the bag handler is carrying a first bag from the conveyor to the gripper.

15. The bag presenter of claim 1 wherein the bag handler is an arm moveable between the conveyor and the gripper and moves to pull the bag upwardly into position for engagement by the gripper.

16. The bag presenter of claim 1 further comprising a bag feeder for moving a bottom bag from the bag supply to the conveyor.

17. A bag presenter apparatus for use to present a bag for filling by a packaging machine, the bag including a first side panel and an opposite side panel and the packaging machine having a filling station including a filling chute and a filled bag conveyor, the bag presenter apparatus comprising: a bag gripper for holding the bag to be filled by the packaging machine relative to the filling chute of the packaging machine such that materials from the chute can be introduced to the bag and the bag gripper configurable to hold the first side panel of the bag and in a position conducive to engagement of the bag by the filled bag conveyor of the packaging machine and a conveyor for moving the bag from a supply area toward the bag gripper, the conveyor including a belt and a bag orientating device acting relative to the belt to ensure appropriate bag orientation in the conveyor.

18. The bag presenter of claim 17 wherein the bag orientating device includes a stop mechanism, selected to stop advancement of a bag moved by the belt and to orient the bag relative to the belt direction of travel.

19. The bag presenter of claim 18 wherein the stop mechanism is movable into and out of an operable position to stop advancement of a bag.

20. The bag presenter of claim 19 wherein the stop mechanism can be driven to extend through and to retract from, a drive surface plane defined by the surface of the belt.

* * * * *